US006517760B1

(12) United States Patent
Lazzara

(10) Patent No.: US 6,517,760 B1
(45) Date of Patent: Feb. 11, 2003

(54) METHOD FOR MOLDING THE HULL OF A VESSEL

(76) Inventor: Richard C. Lazzara, 1934 Brightwaters Blvd. NE., St. Petersburg, FL (US) 33704

( * ) Notice: Subject to any disclaimer, the term of this patent is extended or adjusted under 35 U.S.C. 154(b) by 0 days.

(21) Appl. No.: 09/549,773

(22) Filed: Apr. 14, 2000

Related U.S. Application Data

(62) Division of application No. 09/183,142, filed on Oct. 30, 1998, now Pat. No. 6,189,855.

(51) Int. Cl.[7] ..... B29C 33/38
(52) U.S. Cl. ..... 264/219; 29/469
(58) Field of Search ..... 264/219; 29/469

(56) References Cited

U.S. PATENT DOCUMENTS

| | | | | | |
|---|---|---|---|---|---|
| 1,527,551 | A | | 2/1925 | Hollis | 249/15 |
| 1,535,023 | A | | 4/1925 | Kelley | 249/1 |
| 2,356,860 | A | | 8/1944 | Lewis | 425/389 |
| 3,805,533 | A | | 4/1974 | Askey et al. | 405/259.6 |
| 3,806,304 | A | * | 4/1974 | Tighe | 249/168 |
| 4,120,632 | A | * | 10/1978 | Stoeberl | 264/46.6 |
| 4,416,440 | A | | 11/1983 | Bowman et al. | 249/82 |
| 4,543,284 | A | * | 9/1985 | Baum | 156/245 |
| 4,657,794 | A | | 4/1987 | Schultze et al. | 428/36 |
| 5,113,751 | A | | 5/1992 | Holcomb et al. | 99/286 |
| 5,217,727 | A | | 6/1993 | Kameyama et al. | 425/185 |
| 6,021,732 | A | * | 2/2000 | Hobbs | 264/219 |
| 6,040,080 | A | | 3/2000 | Minami | 429/96 |
| 6,149,844 | A | * | 11/2000 | Graham | 264/258 |

* cited by examiner

*Primary Examiner*—Allan R. Kuhns
(74) *Attorney, Agent, or Firm*—Holland & Knight LLP

(57) ABSTRACT

A method and apparatus for molding the hulls of vessels comprises a plurality of individual starboard base panels, starboard side panels, port base panels and port side panels, interconnected in a number of respective first panel groups and second panel groups, which groups are then connected side-by-side along the length of the vessel hull to be formed. The first panel groups are longitudinally spaced from one another and carried by adjustable vertical supports, whereas the second panel groups are removably mounted in between adjacent first panel groups to form a continuous negative mold surface against which the vessel hull can be constructed. After the hull has been formed, the second panel groups are removed while the first panel groups remain in place, a number of trolley devices are positioned beneath the hull in the spaces vacated by the second panel groups, and then the vertical supports are operated to lower the hull onto the trolley devices at which time the first panel groups can be disassembled thus allowing the hull to be transported on the trolley devices.

4 Claims, 5 Drawing Sheets

METHOD FOR MOLDING THE HULL OF A VESSEL

This is a divisional of application(s) Ser. No. 09/183,142 filed on Oct. 30, 1998, now Pat. No. 6,189,855.

FIELD OF THE INVENTION

This invention relates to a method and apparatus for molding vessel hulls, and, more particularly, to a modular molding system and method employing a number of individual mold panels which are removably interconnected with one another to form a continuous negative mold surface, and then disassembled for ease of storage and re-use.

BACKGROUND OF THE INVENTION

Many larger vessels including luxury yachts and sports fishing boats are constructed with a hull and other structural components including composite materials such as fiberglass. Conventionally, formation of the hull, for example, begins with the hand construction of a "positive" mold or "plug" typically made of wood or the like. The desired contours, size and other physical aspects of the finished hull are replicated in the positive mold. The next step is to form the "negative" mold, which historically has been accomplished by hand laying a first layer of fiberglass or other composite material directly onto the positive mold sometimes followed by a core layer made of various substrates which is affixed to the first fiberglass layer. Finally, a second fiberglass layer is applied by hand onto the core, or onto the first fiberglass layer if no core is employed, to form the finished negative mold. The first layer of fiberglass of the negative mold forms a continuous mold surface which matches the shape of the positive mold.

In current practice, the negative mold is formed in one section or two large half sections, i.e., a starboard half section including half of the bottom and the entire starboard side of the hull, and a port half section including the other half of the bottom and the entire port side of the hull. These half sections are connected together to form a complete negative mold, having a substantially continuous mold surface from the bow of the vessel to the stem. The hull is formed by laying up first layers of composite material directly onto the mold surface of the negative mold, followed by a core, usually made of a framework of balsa wood or foam material, and then second layers of composite material laid up on the exposed surface of the core. Once the composite material has cured, the entire hull is lifted from the negative mold by an overhead crane or the like, and moved to another site within the manufacturing facility for further construction of the vessel. The negative mold is disassembled into its two half sections, and stored for re-use.

The method and apparatus for constructing the hull of vessels described above has a number of limitations and disadvantages. One problem relates to scale. Many luxury yachts and larger sport fishing vessels are in the range of fifty to one hundred ten feet long or more. It can be appreciated that the sheer size and height of a single section, or port and starboard half sections, forming the negative mold present a number of difficulties with handling and storage. A very large facility is required to store mold section or half sections of the size noted above, and if the manufacturer builds a number of different vessel sizes and/or models, the storage and handling problems increase dramatically. In many instances, manufacturers are limited to constructing only one vessel at a time because the rest of the space in their manufacturing facility is taken up with the storage of the negative mold sections.

Another significant problem with the negative molds described above is that they cannot be utilized to construct hulls of different sizes and/or shapes. As described above, current negative molds are formed in continuous starboard and port half sections, which are interconnected at the center, thus allowing only one vessel hull to be formed therefrom. When the manufacturer desires to change the hull shape or size, e.g., width, length or height, a completely new negative mold must be constructed in accordance with the method outlined above. This is an extremely expensive and time consuming operation, and results in the formation of a new set of negative mold half sections which themselves take up valuable storage space in the facilities of the vessel manufacturer.

A further problem with the method and mold apparatus described above is related to handling of the vessel hull once it is formed. As described above, the bottom and sides of the vessel hull are formed against the mold surface of the negative mold, and allowed to cure. In order to separate the hull from the negative mold, an overhead crane or similar device must be utilized to lift the hull from the negative mold and move it to another location for further handling. This requires a manufacturing facility having comparatively high ceilings, and an expensive, heavy-duty overhead crane capable of lifting the entire hull.

SUMMARY OF THE INVENTION

It is therefore among the objectives of this invention to provide a method and apparatus for molding the hulls of vessels which substantially reduces the storage space required for the negative mold, which eliminates the need for overhead cranes to "pull" or transport the molded vessel hull, which allows the same negative mold to be used in the fabrication of vessel hulls of different size and shape, and, which reduces the expense of negative mold construction and storage.

These objectives are accomplished in accordance with the method of this invention, employing an apparatus which comprises a plurality of individual starboard base panels, starboard side panels, port base panels and port side panels, interconnected in a number of respective first panel groups and second panel groups, which groups are then connected end-to-end along the length of the vessel hull to be formed. The first panel groups are longitudinally spaced from one another and individually mounted on adjustable vertical supports, whereas the second panel groups are removably mounted in between adjacent first panel groups to form a continuous negative mold surface against which the vessel hull can be constructed. After the hull has been formed, the second panel groups are removed while the first panel groups remain in place, a number of trolley devices are positioned beneath the hull in the spaces vacated by the second panel groups, and then the vertical supports are operated to lower the hull onto the trolley devices at which time the first panel groups can be disassembled thus allowing the hull to be transported on the trolley devices to a location in the manufacturing facility for further construction.

One aspect of this invention is predicated upon the concept of forming a negative mold from a number of individual mold panels, instead of a single section or two large half sections as in prior molding methods and apparatus of the type described above. Each mold panel of this invention is formed on a positive mold, similar to conventional techniques, but the individual mold panels are comparatively small in size. Each mold panel is formed with a peripheral flange, and the flanges of adjacent panels abut one another when the panels are assembled. The panels are interconnected along their abutting flanges with a unique bolt assembly, described in detail below, to form the completed negative mold of this invention.

The modular nature of this invention is important in a number of respects. First, the individual mold panels are relatively small making handling and storage much less of a problem than the huge single section or half section, negative molds currently employed and described above. The individual panels can be stored off site, if desired, and therefore free up valuable space in a manufacturing facility for the construction of vessels instead of the storage of negative molds.

Secondly, the modular mold panels of this invention can be employed to fabricate vessel hulls of different size and shape. As noted above, the base of the negative mold herein includes a number of first groups of starboard and port base panels longitudinally spaced along the length of the hull to be constructed, and a number of second groups of starboard and port base panels connected between adjacent first groups. In turn, individual base panels within each group are connected to one another along their abutting flanges. In one presently preferred embodiment, the overall width of the vessel hull can be increased by placing spacers between adjacent base panels within each group, as desired. Alternatively, the side panels forming the starboard side and the port side of the mold herein may be located at one or more positions atop the base panels, i.e., at different distances from the centerline of the base section, to vary the overall width of the vessel hull. Additionally, the vessel length may be increased or decreased by changing the number of first and second groups of base panels and side panels employed.

The starboard side and port side of the negative mold of this invention are both constructed to obtain variations in the height of the sides of the vessel, and an increase or decrease in vessel length, as desired. The starboard side consists of a number of first groups of individual starboard side panels connected one on top of the other and carried by the adjustable vertical supports noted above, and a number of second groups of starboard side panels connected one on top of the other and connected between adjacent first groups of starboard side panels. The port side is similarly constructed with alternating first and second groups of port side panels, with each first group of port side panels being carried by adjustable vertical supports, and the second groups of port side panels being removably mounted between adjacent first port side panel groups. The vessel size and shape can be varied by altering the number of panels within each group, and/or changing the number of groups along the length of the negative mold.

The above-described modular construction of the starboard side and port side of the negative mold of this invention also facilitates handling of the vessel hull after it is formed. As described above, previous molding systems required the use of an overhead crane to lift the entire hull from the negative mold half sections for further handling. This step is eliminated by the method of this invention. In the presently preferred embodiment, after the vessel hull is laid up against the negative mold herein, the second groups of starboard base panels, starboard side panels, port base panels and port side panels are removed while the first groups of starboard base panels, starboard side panels, port base panels and port side panels remain in place. A number of trolley devices are then rolled into position beneath the vessel hull in the spaces vacated by the removed second panel groups. The adjustable vertical supports which carry the remaining first groups of panels are then operated to lower such first panel groups, and, hence, the vessel hull, onto the trolley devices. Once the weight of the hull is carried by the trolley devices, the remaining first groups of panels are disassembled allowing the hull to be transported on the trolley devices to any desired location within the manufacturing facility for further construction of the vessel.

BRIEF DESCRIPTION OF THE DRAWINGS

The structure, operation and advantages of this invention will become further apparent upon consideration of the following description, taken in conjunction with the accompanying drawings, wherein.

DETAILED DESCRIPTION OF THE INVENTION

Figures 1, 2, 3:
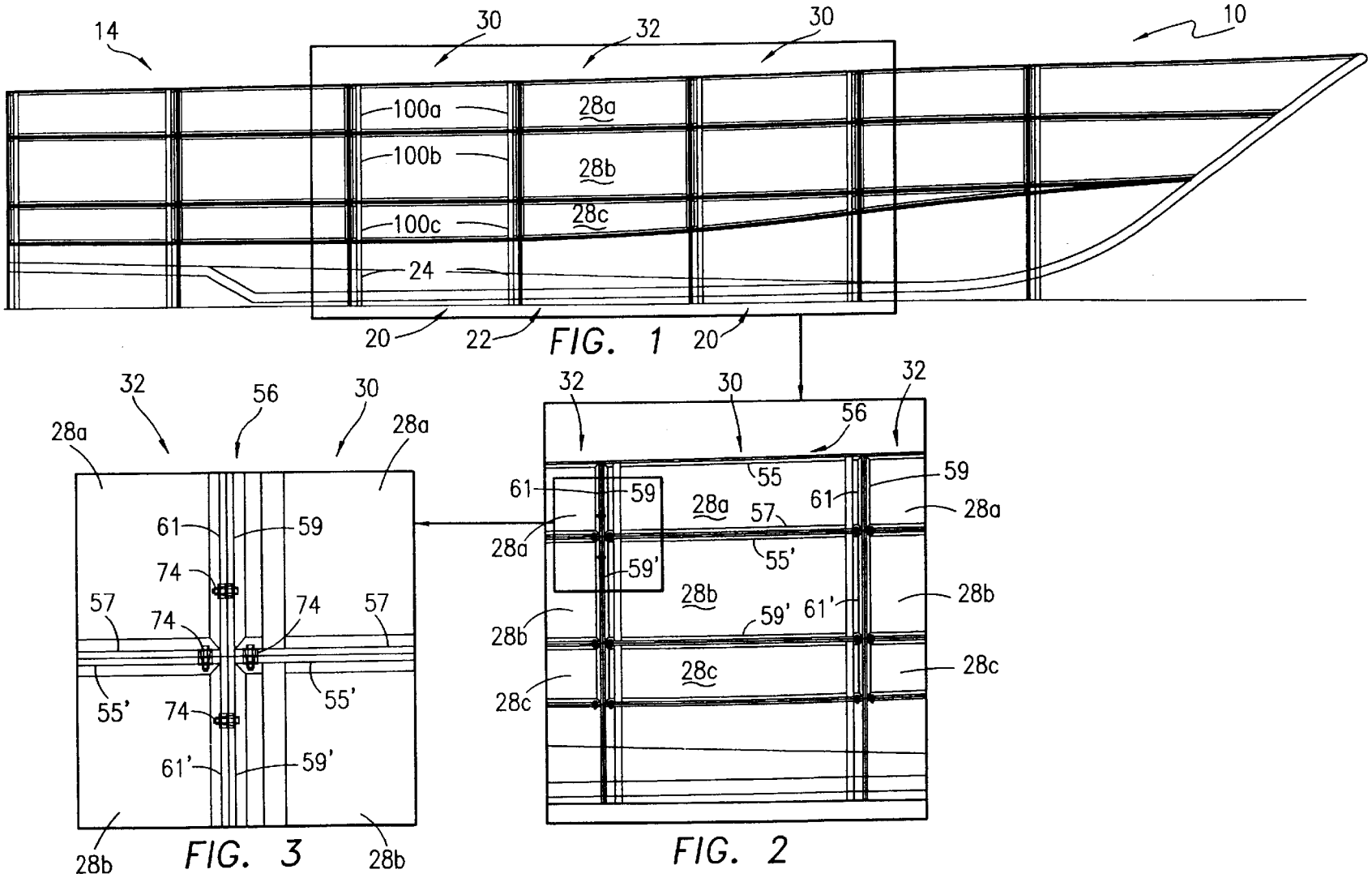
FIG. 1 is a side view of the port half section of the negative mold of this invention.
FIG. 2 is an enlarged view of a portion of the negative mold identified in FIG. 1.
FIG. 3 is an enlarged view of the juncture of several panels, as identified in FIG. 2.
Figure 6:
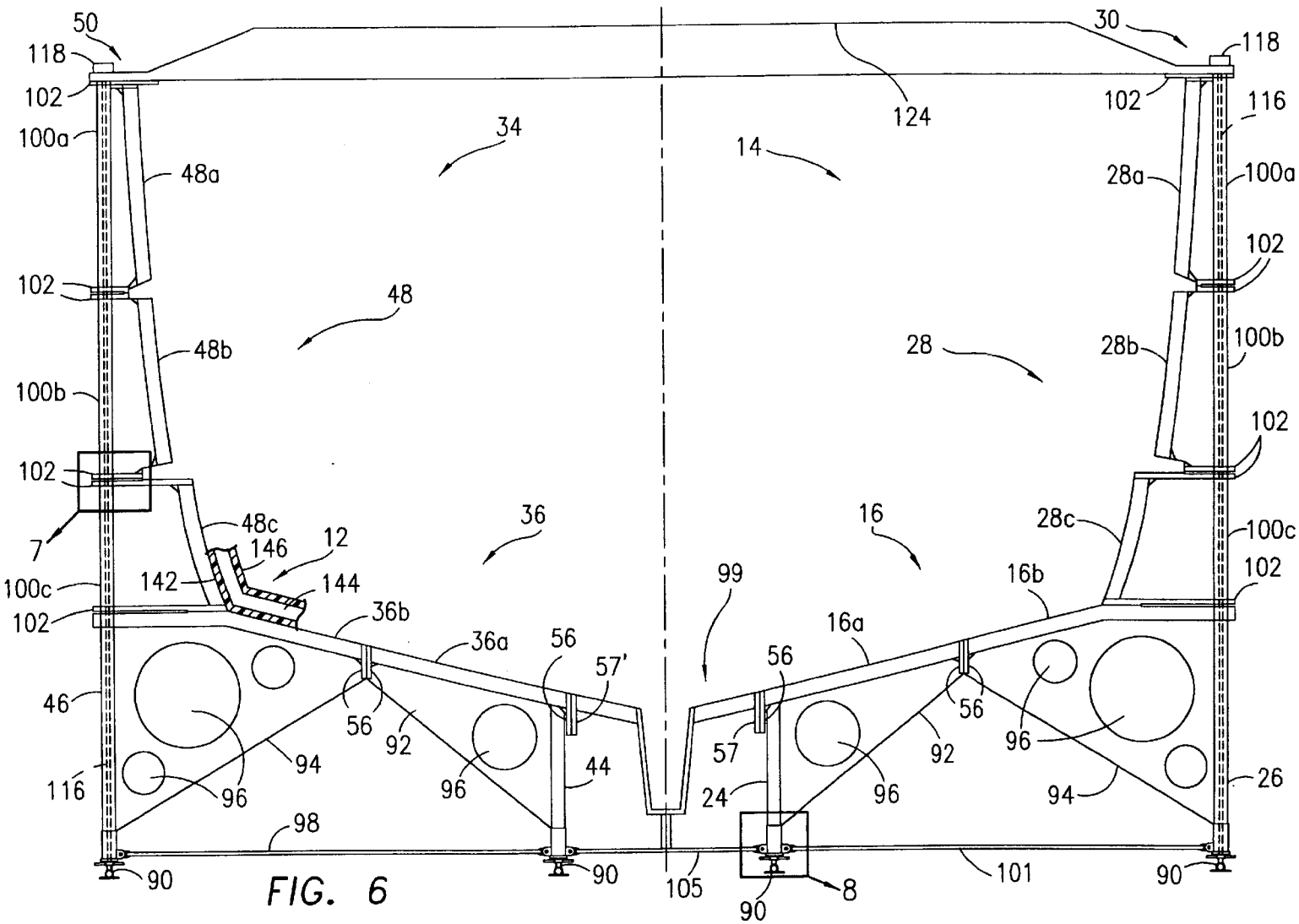
FIG. 6 is an end view of one embodiment of the entire negative mold of this invention.

Referring now to the drawings, the molding apparatus 10 of this invention is modular in construction and generally comprises a port side and a starboard side each including a number of individual base panels and side panels, described in detail below, which are interconnected side-by-side and end-to-end to form a negative mold for the manufacture of the hull 12 of a vessel such as a yacht or sport fishing craft. For ease of illustration, a portion of the side elevational view of the molding apparatus 10 is depicted in FIG. 1, and an end view of the entire apparatus 10 is shown in FIG. 6. The starboard side and port side of the apparatus 10, including the base panels and side panels, are essentially the same in construction and operation. Consequently, the discussion which follows is primarily directed to the port side of the molding apparatus 10, it being understood that such discussion applies to the starboard side as well.

Overall Construction of Negative Mold

For purposes of the present discussion, the terms "upper" and "top," and variants thereof, refer to the vertically upward direction as the hull 12 and/or apparatus 10 as depicted in FIGS. 1 and 6, whereas the terms "lower" and "bottom," and variants thereof, refer to the opposite direction. Additionally, the term "inner" refers to a position or location toward the center of apparatus 10, while "outer" refers to the opposite position or location. Further, the apparatus 10 and hull 12 are considered to have a longitudinal axis extending from bow to stem, and therefore the terms "longitudinally spaced" refer to a direction along such longitudinal axis, the term "end-to-end" refers to the longitudinal direction, and, the term "side-by-side" refers to a direction transverse to the longitudinal direction.

In the presently preferred embodiment, the port side 14 of the molding apparatus 10 includes a plurality of port base panels 16 and port side panels 28 which are interconnected as described in detail below. The port base panels 16 are arranged in alternating pairs of groups 20 and 22, each consisting of an inner base panel 16*a* and an outer base panel 16*b*. Adjacent inner base panels 16*a* within the groups 20, 22 are connected end-to-end from the bow to the stern of the molding apparatus 10, and each inner base panel 16*a* is connected side-by-side to a corresponding outer base panel 16*b* within the respective groups 20, 22 to form the entire base portion of the port side 14. As such, individual groups 20 of base panels 16 are longitudinally spaced from one another with the groups 22 of base panels 16 being connected between adjacent groups 20. In the presently preferred embodiment, the inner base panel 16*a* of each group 20 is supported at one end by a pair of vertical tubes 24, and one end of the outer base panel 16*b* in each group 20 is supported by a pair of vertical tubes 26, one of which is shown in the Figures. These tubes 24, 26, and their connection to base panels 16*a* and 16*b*, is described in more detail below.

The side or wall of the port side 14 of molding apparatus 10 is formed of a number of individual port side panels 28 including an uppermost port side panel 28*a*, an intermediate port side panel 28*b*, and, a lowermost port side panel 28*c*. As best seen in FIG. 1, the port side panels 28 extend longitudinally from the bow to the stem of the molding apparatus 10 forming alternating groups of panels, with the port side panels 28 in each group being stacked on top of the other. In particular, longitudinally spaced groups 30 of port side panels 28*a*–28*c* are supported on a series of vertical tubes, described in more detail below. A second group 32 of port side panels 28*a*–*c* is connected in between each of the first groups 30. Within each group 30 and 32, the port side panels 28*a*–*c* are mounted one on top of the other, with the lowermost port side panel 28*c* resting atop an outer base panel 16*b*. See also FIG. 6.

As mentioned above, molding apparatus 10 includes a starboard side 34 which is structurally and functionally identical to the port side 14 described above. The starboard side 34 of molding apparatus 10 includes starboard base panels 36 and starboard side panels 48. The starboard base panels 36 include inner base panels 36*a* and outer base panels 36*b* which are arranged in alternating pairs or groups 40 and 42 of adjacent panels 36*a* and 36*b* extending along the length of the apparatus 10. Each inner base panel 36*a* is supported at one end by a pair of tubes 44, and each outer base panel 36*b* is supported at one end by a pair of tubes 46.

The walls or side of the starboard side 34 of molding apparatus 10 include a number of starboard side panels 48 forming an uppermost side panel 48*a*, an intermediate side panel 48*b*, and, a lowermost side panel 48*c*. As with the port side section 14 of this invention, the starboard side section 34 includes a number of alternating groups 50 and 52 of starboard side panels 48, which groups 50, 52 are connected end-to-end along the length of apparatus 10. Each group 50 of starboard side panels 48 is vertically supported by tubes, described in detail below, whereas the groups 52 of starboard side panels 48 are connected in between adjacent groups 50. The lowermost side panel 48*c* within each group 50 and 52 rests atop one of the outer base panels 36*b*.

Individual Panel Construction and Joint Structure

Figure 5:
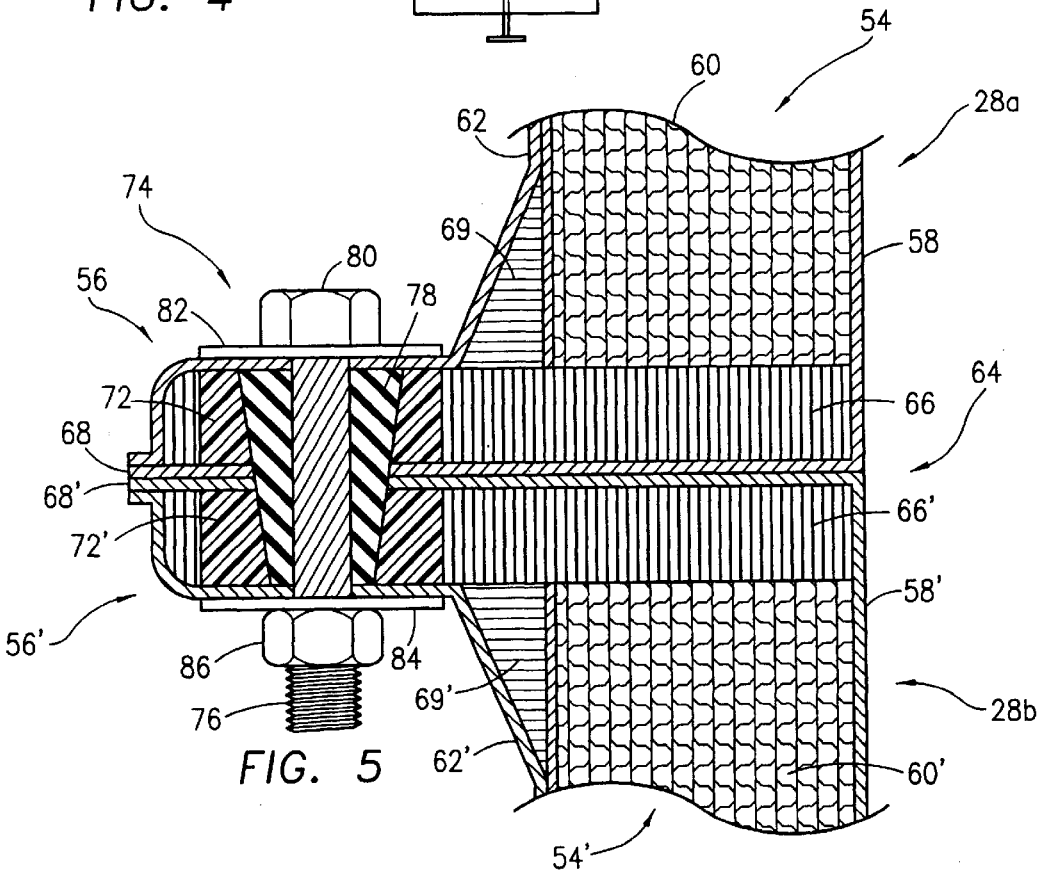
FIG. 5 is an enlarged view, in partial cross section, of a joint connection between abutting flanges of the mold panels herein.

Referring now to FIGS. 2, 3 and 5, the construction of the individual panels, and how they are interconnected to one another, is discussed. For purposes of the present description, the connection between an uppermost port side panel 28*a* and an intermediate port side panel 28*b* is shown in FIG. 5 and described below, it being understood that all of the other panels forming the molding apparatus 10 of this invention are similarly constructed and interconnected.

As best seen in FIGS. 2 and 5, the port side panel 28*a* includes a body section 54 connected to a generally rectangular shaped peripheral flange 56. The same elements of port side panel 28*b* are identified with the same reference numbers in FIGS. 2, 3 and 5, except for the addition of a "'" to the panel 28*b* structure. Each body section 54, 54' is made in a conventional manner on a positive mold (not shown) by first laying up composite material such as fiberglass to form an inner layer 58, 58', affixing a core 60, 60', preferably formed of corrugated cardboard, foam material or the like, to respective inner layers 58, 58', and then laying up an outer layer 62, 62' onto each core 60, 60'. The outer layers 62, 62' are also formed of a composite material such as fiberglass. Once molded, the inner layers 58, 58' of the body sections 54, 54'of port side panels 28*a* and 28*b*, together with all of the other starboard and port panels, collectively form a mold surface 64 against which the hull 12 of the vessel can be formed, as described below. Further details of the construction of the body sections 54, 54' of the port side panels 28*a* and 28*b* form no part of this invention, and therefore are not discussed herein.

In the presently preferred embodiment, the peripheral flange 56 of uppermost port side panel 28*a* comprises a center section 66, preferably formed of balsa wood, extending from the inner layer 58 of body section 54 and through the core 60 thereof. The outer layer 62 of body section 54 extends outwardly from the core 60 of the panel in the area of flange 56, wraps around the outside of the balsa wood center section 66, and, abuts a horizontally extending layer 68 formed of a composite material such as fiberglass. Preferably, a filler material 69 is inserted in the area where the outer layer 62 separates from core 60. The port side panel 28*b* has the same construction, and is shown in FIG. 5 such that the layers 68, 68' of respective panels 28*a* and 28*b* abut one another.

As seen in FIGS. 1 and 2, the peripheral flange 56 of each panel is substantially rectangular in shape. The uppermost port side panel 28*a* of FIG. 2, for example, includes opposed upper and lower side walls 55 and 57, and opposed end walls 59 and 61. As such, the upper side wall 55' of the flange 56' of the intermediate port side panel 28*b* abuts the lower side wall 57 of the flange 56 of uppermost port side panel 28*a*. The end walls 59 and 61 of the flange 56 of uppermost port side panel 28*a* within a group 30 of panels 28 abut the end walls 61 and 59, respectively, of the uppermost port side panel 28*a* from adjacent groups 32 on either end thereof. All of the panels in the entire molding apparatus 10 abut one another in this fashion, e.g., wherein the side walls 55, 57 of the peripheral flanges 56 within individual panel groups contact one another, and the end walls 59, 61 of adjacent groups contact each other in an end-to-end direction.

The view in FIG. 5 depicts the joint connection of this invention wherein abutting flanges 56, 56' of adjacent panels are releasably interconnected to one another. As noted above, the outer layers 62, 62' of respective panels 28*a,* 28*b* are extended in the area of the flanges 56, 56' so that they taper outwardly from the panel cores 60, 60' to the center section 66, 66' of the flanges 56, 56'. The outer layers 62, 62' wrap around the respective center sections 66 and 66' and abut the composite layers 68, 68'. These composite layer 68, 68', in turn, are essentially an extension of one of the top, bottom or sides of the body section 54, 54' of respective panels 28*a,* 28*b.*

In the presently preferred embodiment, a throughbore is formed in the outer end of each balsa wood center section 66, 66' of panels 28*a,* 28*b,* and is filled with potting material 72, 72'. The potting material 72 extends between the outer layer 62 and composite layer 68 of the flange 56 of panel 28*a,* and the potting material 72' extends between the outer layer 62' and composite layer 68' of panel 28*b.* After the individual panels 28*a,* 28*b* of this invention are laid up on the positive mold and allowed to cure, with adjacent, abutting flanges 56, 56' still in contact with one another, a tapered boring tool (not shown) is employed to drill a tapered hole through the outer end of the flange 56 of panel 28*a,* and then through the outer end of the flange 56' of the abutting panel 28*b.* As such, the throughbore extends through the potting material 72, 72' of each flange 56, 56' and through the outer layers 62, 62' and composite layers 68, 68' of respective panels. In the presently preferred embodiment, the continuous, tapered throughbore receives a mounting device 74 consisting of a bolt 76 encased within a tapered, jacket 78, preferably formed of polyurethane or a similar resilient material. A cap 80 having a integral washer 82 is affixed to one end of the bolt 76, with the washer 82 engaging the outer layer 62 of the flanges 56 of panel 28*a.* The opposite, threaded end of the bolt 76 receives a washer 84, and nut 86 which is tightened down against the outer layer 62' of the flange 56' of panel 28*b.* The mounting device 74 and potting material 72, 72' collectively form a joint connection which is employed to interconnect all of the panels of this invention to one another in a side-to-side or end-to-end orientation. For example, FIG. 3 depicts two port side panels 28*a* and 28*b* of one group 30, which are oriented one on top of the other and located in end-to-end abutment with the port side panels 28*a* and 28*b* of an adjacent group 32. Mounting devices 74 are employed to interconnect respective port side panels 28*a* and 28*b* within each group 30 and 32, and mounting devices 74 also interconnect the port side panels 28*a,* 28*b* of group 30 with respective port side panels 28*a,* 28*b* of group 32, as shown.

The joint connection provided by the mounting devices 74 of this invention provide a secure side-to-side and end-to-end connection between abutting panels of the molding apparatus 10. Additionally, because the tapered throughbore which receives the mounting device 74 is formed in the flanges 56 of abutting panels while they remain on the positive mold, precise alignment is obtained when the panels are later assembled to form the molding apparatus 10 of this invention. This ensures that the resulting mold surface 64 of the entire mold apparatus 10 effectively replicates the positive mold against which each panel was formed.

Vertical Support and Attachment of Panel Groups

One advantage of this invention, described in more detail below in connection with a discussion of the molding method herein, results from the arrangement of panels in both the port side 14 and starboard side 34 in longitudinally extending groups from the bow to the stern of the molding apparatus 10. The groups 20 of port base panels 16 are longitudinally spaced along the length of molding apparatus 10 and align with the groups 30 of port side panels 28. Similarly, the groups 40 of starboard base panels 36 are longitudinally spaced from one another and align with the groups 50 of starboard side panels 48. All of these groups 20, 30, 40 and 50 collectively align with one another, and are supported by vertical tubes in a manner described herein. The other groups 22, 32, 42 and 52 of panels are located in between respective groups 20, 30, 40 and 50, and are supported thereto along their abutting flanges 56 by mounting devices 74, in the manner described above.

Referring to FIGS. 1 and 6–8, the vertical support of panel groups 20, 30, 40 and 50 is illustrated in detail. For purposes of the present discussion, one port base panel group 20 and one port side panel group 30 is described herein, it being understood that all other groups 20, 30, 40 and 50 are similarly interconnected and vertically supported.

As described above, each port base panel group 20 includes an inner base panel 16*a* and an outer base panel 16*b* connected along their abutting flanges 56. The inner base panel 16*a* is supported at one end by a tube 24 whose upper end connects to the underside of the base panel 16*a,* with the bottom end thereof being received within a sleeve 88. The sleeve 88, in turn, is mounted atop a jack 90 having a threaded shaft 91 connected at one end to a ball 93 carried within a generally cup-shaped seat 95. The shaft 91 is rotated by a handle 97 to raise and lower the sleeve 88, and, hence, the tube 24, with respect to the floor upon which the jack 90 rests. Similarly, the outer end of outer base panel 16*b* is supported by the tube 26 extending between the underside of base panel 16*b* and into a sleeve 88 mounted upon a jack 90. Each pair or group 20 of base panels 16*a* and 16*b* is supported by a pair of longitudinally spaced tubes 24 and a pair of aligning tubes 26 for stability, only one of which is shown in FIG. 6 for ease of illustration.

In the presently preferred embodiment, a first gusset 92 extends from the tube 24 to the flange 56 of inner base panel 16*a,* and a second gusset 94 extends from the flange 56 of outer base panel 16*b* to the tube 26. Each of these gussets 92, 94 is preferably formed with a core covered on either side by a layer of composite such as fiberglass. Spaced bores are formed in gussets 92, 94, such as at 96, to reduce weight and the amount of material utilized.

The base portion of the starboard side of the molding apparatus 10 is similarly constructed. Each group 40 of starboard base panels includes an inner base panel 36*a* mounted at one end to the top of a pair of tubes 44, and an outer base panel 36*b* carried at one end by a pair of tubes 46. The panels 36*a,* 36*b* are connected together at their abutting flanges 56. The bottom end of each tube 44 and 46 is received within a sleeve 88, which, in turn, mounts to a vertically adjustable jack 90. Gussets 92 and 94 are connected between respective tubes 44, 46 and panels 36*a,* 36*b* in the same manner as discussed above in describing port base panels 16*a,* 16*b.*

The base portion of molding apparatus 10 is assembled to obtain maximum strength in an end-to-end or longitudinal direction, as well as in a side-by-side or transverse direction. In the presently preferred embodiment, the molding apparatus 10 includes a substantially, longitudinally continuous center section 99 having opposed flanges 57, 57'. The center section 99 spans the gap or distance between the port side 14 and starboard side 34, along the base portions thereof. The inner edge of each port base panel 16*a* is formed with a flange 56 which abuts the port flange 57 of center section 99, and the inner edge of each starboard base panel 36*a* is formed with a flange 56 which abuts the starboard flange 57' of center section 99. The flanges 57, 57' are identical to flanges 56, and the same mounting device 74 described above is employed to interconnect the center section 99 with the base panels 16*a* and 36*a*.

Figure 8:
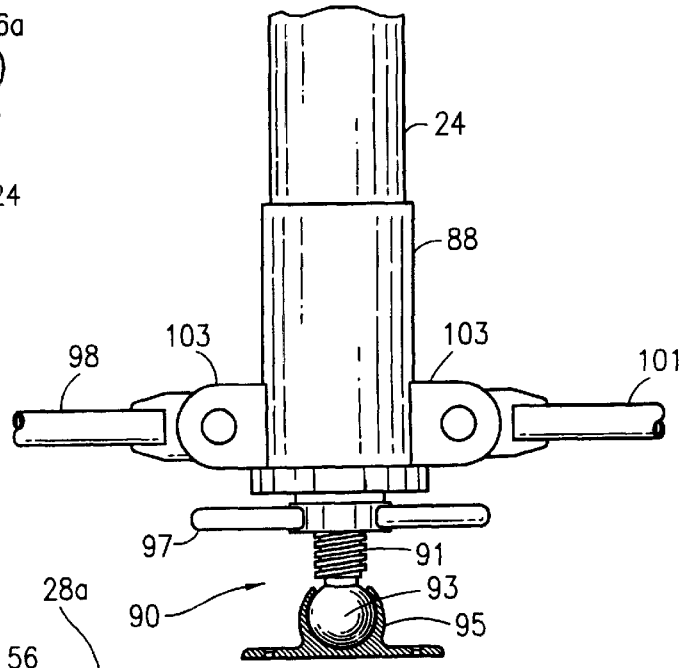
FIG. 8 is an enlarged view of the base of a vertical support, identified in FIG. 6, including an adjustable jack and the end portions of two tie rods.
Figure 7:
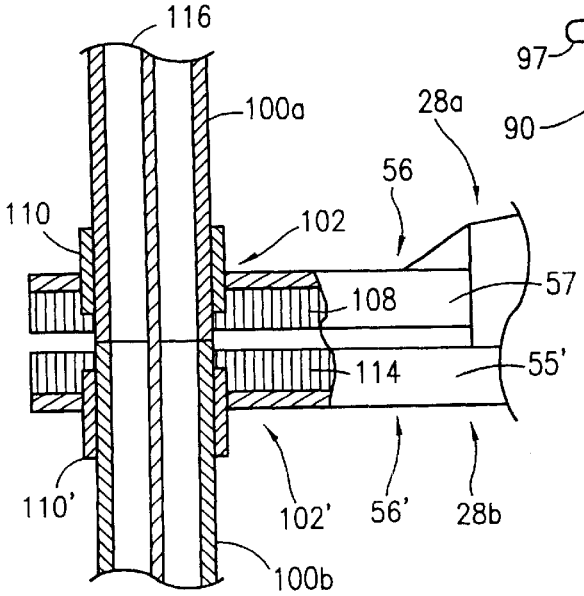
FIG. 7 is a cross-sectional view of the connection of adjacent panels to a vertical support, as identified in FIG. 6.

Side-by-side or transverse structural integrity at the base of the molding apparatus 10 is provided by: (1) the connections between abutting starboard base panels 36*a*, 36*b*, the center section 99, and abutting port base panels 16*a*, 16*b*; (2) the gussets 92 and 94 mounted between the tubes 44, 46 and base panels 36*a*, 36*b*, as well as the tubes 24, 26 and base panels 16*a*, 16*b*; and, (3) a series of tie rods extending across the entire width of molding apparatus 10. Preferably, an outer tie rod 98 is mounted between the tubes 44, 46 on the starboard side of the base, and an outer tie rod 101 is mounted between the tubes 24, 26 on the port side. As depicted in FIG. 8, the end of each tie rod 98 or 101 is connected to a projection 103 extending from a sleeve 88. Additionally, an inner tie rod 105 is connected between the tube 24 on the port side of the negative mold, and the tube 44 on the starboard side, in the same manner as tie rods 98, 101. The top portion of molding apparatus 10 is also retained in a side-by-side or transverse direction, as described below.

Referring again to the port side 14 of molding apparatus 10, one group 30 of port side panels 28*a–c* is illustrated in FIG. 6. As described above, abutting flanges 56 of the port side panels 28*a–c* are connected to one another by the mounting devices 74. Additional vertical stability is provided by vertical supports in the manner described below. It should be understood that the starboard side panels 48*a–c* within groups 50 are vertically supported in the same fashion as described below in connection with a discussion of port side panels 28*a–c*.

Each group 30 of port side panels 28*a*, 28*b* and 28*c* is carried by two sets of aligning tubes 100*a*, 100*b* and 100*c*, respectively, one set of which is located at opposed ends of the panels 28*a–c* as best seen in FIG. 1. These tubes 100*a–c*, in turn, align with one of the lower tubes 26 at the outer edge of an outer base panel 16*b* of port side section 14. In the presently preferred embodiment, the tubes 100*a–c* are retained in a vertical orientation by metal plates 102 secured within the flange 56 of each port side panel 28*a–c*. Considering port side panels 28*a* and 28*b* for example, and with particular reference to FIG. 7, the bottom side wall 57 of the flange 56 of port side panel 28*a* is shown abutting the upper side wall 55' of the flange 56' of the port side panel 28*b*. The flange 56 in panel 28*a* is formed with a throughbore which aligns with a throughbore in the flange 56' of panel 28*b*. The upwardly facing surface of panel 28*a* is formed with a recess 108 within which one plate 102 is mounted. Preferably, a ring 110 is secured within a throughbore formed in plate 102, such that a portion of the ring 110 protrudes from opposite sides of the plate 102. One end of ring 110 is received within the throughbore of panel 28*a*, and the opposite end extends outwardly in an upward direction from the panel 28*a*. A second plate 102' having a ring 110' is similarly mounted within a recess 114 formed in the flange 56' of panel 28*b*. With the plates 102 and 102' in this position, the bottom of tube 100*a* is inserted through the ring 110 of plate 102 into the throughbore of panel 28*a*, and the top of tube 100*b* is inserted into the throughbore of panel 28*b* through the plate 102' and its ring 110'. The tubes 100*a* and 100*b* abut one another at approximately the juncture of panels 28*a* and 28*b*, and are maintained by the sleeves 110, 100' in alignment with one another and the bottom tube 26 beneath the outer base panel 16*b*.

As seen in FIG. 6, the same arrangement of plates 102 is provided at the juncture of side panels 28*b* and 28*c* to support the bottom of tube 100*b* and the top of tube 100*c*, in the same manner as described above. Additionally, the upper side wall 55 of the flange 56 of side panel 28*a* receives a plate 102 which supports the top end of tube 100*a*, whereas the lower side wall 57 of the flange 56 of panel 28*c* mounts the base of tube 100*c* in alignment with the bottom tube 26. Consequently, the three tubes 100*a–c*, and the bottom tube 26, abut and align with one another from the top of the group 30 of port side panels 28*a–c* to the bottom.

In order to stabilize the tubes 100*a–c* and 46 and maintain them in abutment with one another, a cable 116 is extended from the upper tube 100*a*, through the tubes 100*b*, 100*c* and bottom tube 26, to the sleeve 88 at the base of bottom tube 26. The cable 116 is tensioned by a nut 118 at the top of tube 100*a*, as shown. Each of the groups 30 of port side panels 28 are secured to respective tubes 100*a–c* and bottom tube 26 along the entire length of the molding apparatus 10, with a separate cable 116 being employed within each set of tubes 100*a–c* and 26. The groups 50 of starboard side panels 48 are similarly mounted to tubes 100*a–c* and bottom tubes 46. This provides the molding apparatus 10 with substantial stability in compression, i.e., in a vertical direction as apparatus 10 is depicted in the Figures.

Additional strength in the transverse direction, or from the port side to the starboard side as shown in the Figures, is provided at the top of molding apparatus 10. In the presently preferred embodiment, and as best seen in FIG. 6, a truss support 124 is mounted at the top of the molding apparatus 10 which extends between the port side 14 and starboard side 34. A number of truss supports 124 are longitudinally spaced along the length of molding apparatus 10, only one of which is shown in the Figures, to resist forces tending to separate or move the port and starboard sides 18, 34 away from one another. Preferably, each truss support 124 is mounted at the upper end of a tube 100*a* atop an uppermost port side panel 28*a* and an uppermost starboard side panel 48*a*.

Variation in the Size and Configuration of the Molding Apparatus

One advantage of the modular construction of the molding apparatus 10 of this invention is its versatility. The same base panels and side panels employed to construct the hull of one vessel may be utilized in the fabrication of another vessel hull having a different width, length and/or side wall height. For example, the overall length of the vessel hull 12 can be altered by removing or adding base panels 16, 36 and side panels 28, 48 as desired. Additional side panels 28 and 48 may be included to increase the height of the sides of the hull 12 above the water line.

Figure 11:
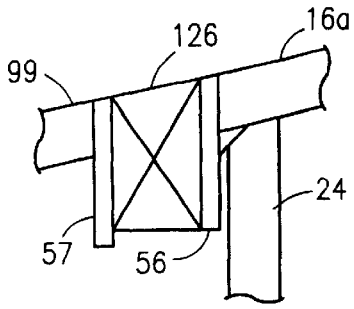
FIG. 11 is an enlarged view of a portion of the base section of the negative mold, as identified in FIG. 10.
Figure 10:
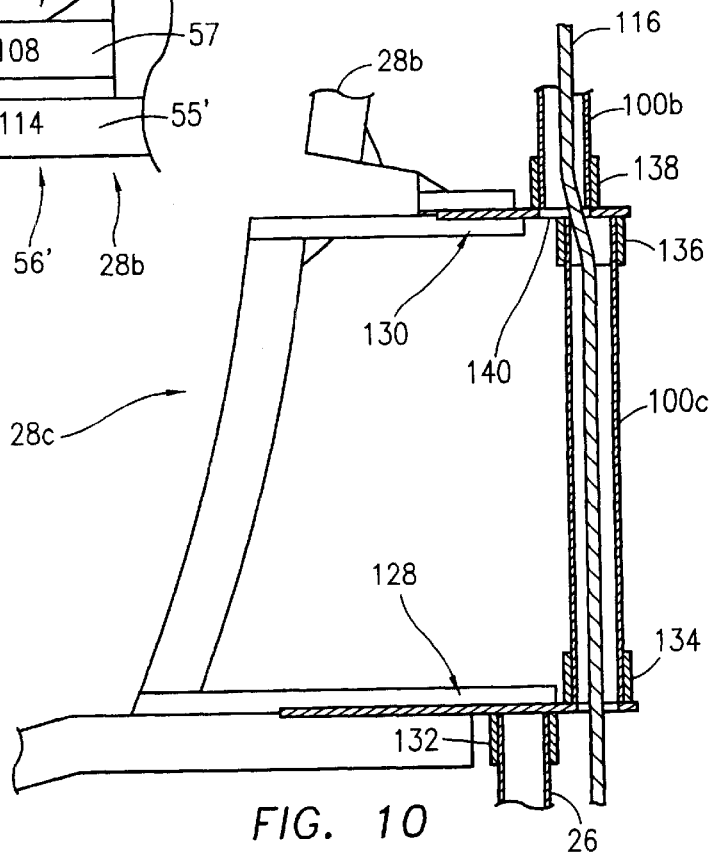
FIG. 10 is an enlarged view of a portion of the port side section of the negative mold, as identified in FIG. 9.
Figure 9:
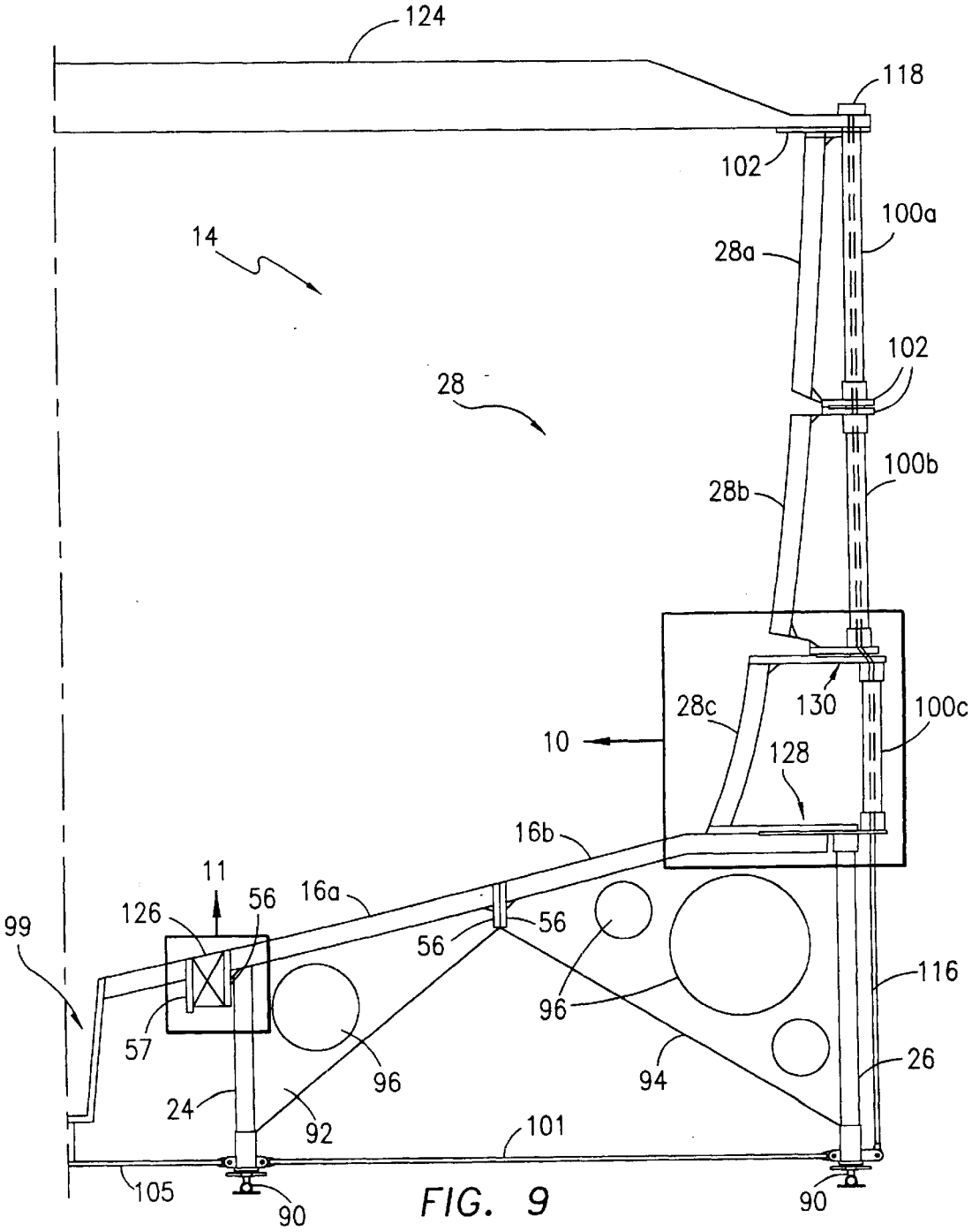
FIG. 9 is a partial end view of an alternative embodiment of the negative mold herein.

Another variation in the hull configuration is obtained with the structure depicted in FIGS. 9–11. As mentioned above, and illustrated in FIG. 6, the center mold section 99 extends along the entire length of the molding apparatus 10 and is formed with opposed flanges 57, 57' which abut the flanges 56 of inner port base panels 16*a* and inner starboard base panels 36*a*. In order to increase the overall width of the molding apparatus 10, the embodiment of FIGS. 9–11 depicts a spacer or expansion block 126 located between the flange 57 of center mold section 99 and the flange 56 of the inner port base panel 16*a*. An expansion block 126 (not shown) is also located between the center mold section 122 and the inner starboard base panels 36*a*. These expansion blocks 126 effectively increase the overall width of molding apparatus 10 without altering any of the other panels or other elements of the apparatus 10, described above.

Alternatively, the overall width of molding apparatus 10 can be increased by sliding the port side panels 28 and starboard side panels 38 outwardly, i.e., in a direction away from the center mold section 99, along the surface of the abutting outer port base panels 16*b* and outer starboard base panels 36*b,* respectively. This requires the use of a first offset plate 128 and a second offset 130, which are shown in FIGS. 9 and 10 mounted to a lowermost port side panel 28*c* and an intermediate port side panel 28*b,* for purposes of illustration. The first offset plate 128 includes a lower ring 132 extending from the underside thereof which receives the upper end of bottom tube 26. A second, upper ring 134 extends from the top surface of first offset plate 128 in position to receive the bottom of tube 100*c* associated with the lowermost port side panel 28*c.* Tube 100*c* extends upwardly from the first offset plate 28 to a lower ring 136 mounted to the second offset plate 130. As depicted in FIG. 10, the lower ring 136 extends from the lowermost surface of second offset plate 130 and overlaps a second, upper ring 138 mounted to the top surface of the second offset plate 130. The second offset plate 130 has an offset bore 140 which forms a continuous passageway from the upper ring 138, though the second offset plate 130 and then through the lower ring 136. The upper ring 138 of second offset plate 130 receives the bottom end of tube 100*b* associated with the intermediate port side panel 28*b.* The upper end of tube 100*b,* and the entirety of tube 100*a,* are mounted to the panels 28*a* and 28*b* as described above. This same construction is employed with the starboard side panels 48*a–c* in each group 50.

With the tubes 100*a–c* and bottom tube 26 in the position depicted in FIGS. 9 and 10, a cable 116 is extended through tubes 100*a,* 100*b* and 100*c* with an offset or jog at the juncture of tubes 100*b* and 100*c.* The cable 116 is exposed from the bottom of tube 100*c* to the sleeve 88 at the base of bottom tube 26 where it is affixed. This construction provides for another means of expanding the width of the molding apparatus 10, while maintaining its structure and integrity in the vertical and side-to-side directions.

Assembly and Operation of Molding Apparatus

The initial step in assembly of the molding apparatus 10 involves interconnecting the pairs or groups 20 of port base panels 16 and groups 40 of starboard base panels 36 along their respective abutting flanges, and vertically supporting them at either end on the bottom tubes 24, 26 and 44, 46, respectively. As noted above, the groups 20 and 40 of base panels 16 and 36 are longitudinally spaced along the length of molding apparatus 10. The groups 22 of port base panels 16 and groups 42 of starboard base panels 36 can then be mounted in between respective panel groups 20 and 40 to form the entire base portion of the molding apparatus 10. The mounting device 74 is employed to interconnect all of these base panels together at their abutting flanges, as described in detail above.

The port side panels 28 and starboard side panels 48 are assembled in a similar fashion. The groups 30 of port side panels 28 are interconnected one on top of the other with the lowermost port side panel 28*c* in each group 30 resting atop an outer port base panel 16*b* beneath. The groups 50 of starboard side panels 48 are interconnected one on top of the other and arranged in alignment with the groups 40 of starboard base panels 36 beneath, with the lowermost starboard side panel 48*c* of each group 50 resting atop a corresponding outer starboard base panel 36*b.* The groups 32 of port side panels 28 and groups 52 of starboard side panels 48 can then be mounted in between adjacent groups 30 and 50, respectively, where they are interconnected along their abutting flanges with mounting devices 74.

The panel groups 20, 30, 40 and 50 are therefore essentially fixed in place by virtue of their connection to the tubes 100*a–c,* and the bottom tubes 24, 26 or 44, 46, when the molding apparatus 10 is assembled. The remaining panel groups 22, 32, 42 and 52 are merely connected between adjacent groups 20, 30, 40 and 50, respectively, and are readily separated therefrom by removing the mounting devices 74 which interconnect their abutting flanges 56.

Once the entire molding apparatus has been assembled as described above, the hull 12 of a vessel is conventionally laid up along the mold surface 64 collectively defined by the individual base and side panels. As schematically depicted in FIG. 6, the hull 12 is formed in a laminated construction including an inner layer 142, a core 144 and an outer layer 146 which engages the mold surface 64 of apparatus 10. The details of the construction of the vessel hull 12 form no part of this invention, and are therefore not described herein.

Figure 4:
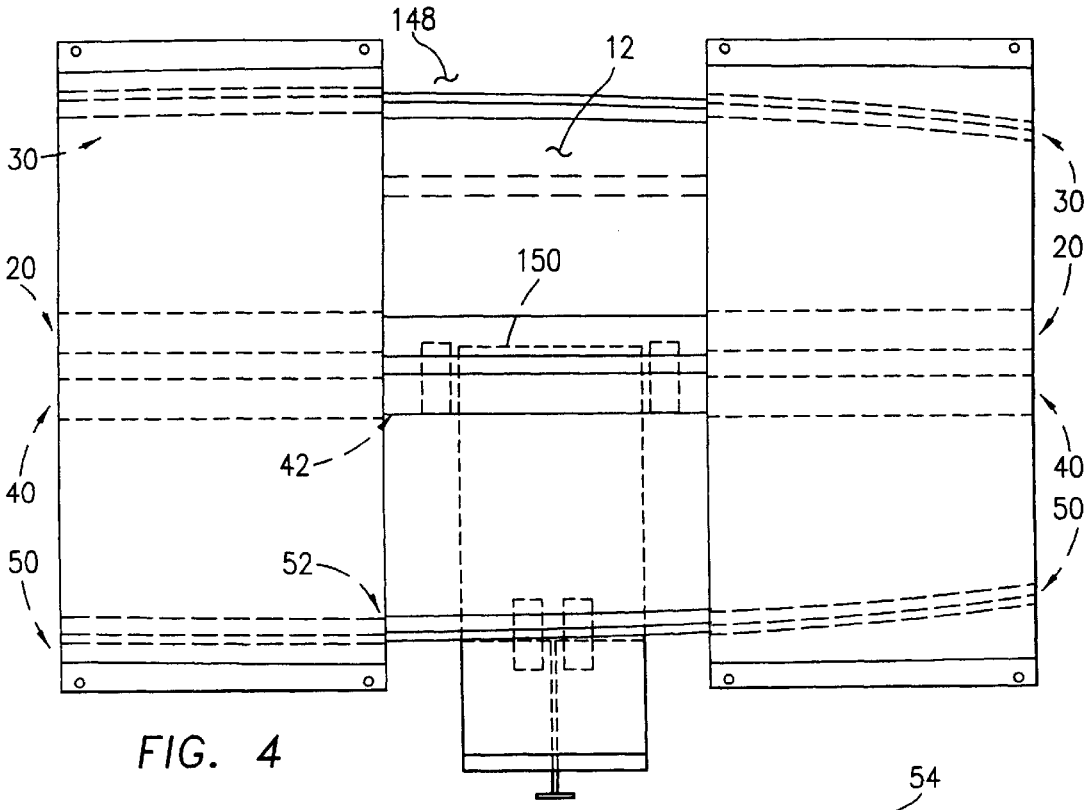
FIG. 4 is a partial plan view of the negative mold of this invention in which a trolley device is shown in place beneath the formed vessel hull and one portion of the negative mold is removed.

Once the vessel hull 12 has been formed and cured, it must be removed from the molding apparatus 10 for further handling. In the past, it was necessary to employ an overhead crane or the like to physically lift the entire hull from a negative mold for movement to another location in the manufacturing facility. The molding apparatus 10 of this invention makes this step unnecessary. As schematically depicted in FIG. 4, after formation of the vessel hull 12, each of the groups 22, 32, 42 and 52 are separated from the remainder of the molding apparatus 10 by removing the mounting devices 74. For purposes of illustration, FIG. 4 depicts the port base panels 16*a, b* and port side panels 28*a–c* within respective groups 22 and 32 removed, while the corresponding starboard base panels 36*a, b* and starboard side panels 48*a–c* of groups 42 and 52 are still in place, but are about to be removed. This creates longitudinally spaced areas 148 where the hull 12 is exposed. The panel groups 20, 30, 40 and 50 remain in place because of their connection to the tubes 100*a–c,* and bottom tubes 24, 26 and 44, 46.

A number of trolley devices 150, one of which is schematically depicted in FIG. 4, are then rolled into place underneath the vessel hull 12 at each of the areas 148 vacated by the removed panel groups 22, 32, 42 and 52. As noted above, all of the bottom tubes 24, 26 and bottom tubes 44, 46 are supported on vertically adjustable jacks 90. When the trolley devices 150 are in place beneath the vessel hull 12, the jacks 90 are operated to lower the entire molding apparatus 10, i.e., the remaining panel groups 20, 30, 40 and 50, which, in turn, lowers the vessel hull 12 onto the trolley devices 150. Once the trolley devices 150 receive the weight of the vessel hull 12, the remaining panel groups 20, 30, 40 and 50 are disassembled leaving exposed the entire vessel hull 12 resting atop the trolley devices 150. The vessel hull 12 is readily moved by the trolley devices 150 to any location in the manufacturing facility for further construction. All of the panels are then stored for reuse in another molding operation.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but the invention will include all embodiments falling within the scope of the appended claims.

What is claimed is:

1. A method of molding the hull of a vessel, comprising:

(a) interconnecting a number of individual starboard base panels end-to-end to form alternating first groups and second groups of starboard base panels, interconnecting a number of individual port base panels end-to-end to form alternating first groups and second groups of port base panels, said first and second groups of starboard base panels and port base panels collectively defining the bottom portion of a negative mold having a longitudinal axis, a starboard side and a port side, the first groups of starboard base panels and port base panels each being mounted on vertical supports, and the second groups of base panels being removably mounted in between adjacent first groups of starboard and port base panels, respectively;

(b) interconnecting a number of starboard side panels, one on top of the other, to form a number of first groups of starboard side panels, and interconnecting a number of port side panels, one on top of the other, to form a number of first groups of port side panels;

(c) mounting the first groups of starboard side panels to a series of vertical supports at longitudinally spaced intervals along the starboard side of the negative mold;

(d) mounting the first groups of port side panels to a series of vertical supports at longitudinally spaced intervals along the port side of the negative mold;

(e) interconnecting a number of starboard side panels, one on top of the other, to form a number of second groups of starboard side panels, interconnecting a number of port side panels, one on top of the other, to form a number of second groups of port side panels;

(f) mounting a second group of starboard side panels in between adjacent first groups of starboard side panels, and mounting a second group of port side panels between adjacent first groups of port side panels, whereby a substantially continuous mold surface is collectively formed by said first and second groups of starboard side panels, port side panels, starboard base panels and port base panels;

(g) forming the hull of the vessel against the mold surface.

2. The method of claim 1 further including the step of:

(h) removing the second groups of starboard base panels and port base panels from between adjacent first groups of starboard base panels and port base panels, respectively, while the vessel hull remains in place;

(i) removing the second groups of starboard side panels from between adjacent first groups of starboard side panels, while the hull remains in place;

(j) removing the second groups of port side panels from between adjacent first groups of port side panels, while the hull remains in place, whereby a number of longitudinally spaced areas exposing the hull are formed where the second groups of base panels, starboard side panels and port side panels are removed.

3. The method of claim 2 further including the steps of:

(k) placing a number of trolley devices beneath the hull of the vessel at each of the longitudinally spaced areas where the hull is exposed;

(1) operating adjustable vertical supports which carry the first groups of starboard base panels, the first groups of port base panels, the first groups of starboard side panels and the first groups of port panels, to lower the vessel hull onto the trolley devices.

4. The method of claim 3 in which step (l) further includes removing each of the first groups of starboard base panels, port base panels, starboard side panels and port side panels once the vessel hull rests atop the trolley devices.

* * * * *